United States Patent [19]

Vorhees

[11] 4,092,792

[45] June 6, 1978

[54] FRAME ASSEMBLY FOR SIGNS

[76] Inventor: Charles Vorhees, 3844 Riverside Dr., Columbus, Ohio 43220

[21] Appl. No.: 708,404

[22] Filed: Jul. 26, 1965

[51] Int. Cl.[2] ..... G09F 7/18

[52] U.S. Cl. ..... 40/607; 40/611

[58] Field of Search ..... 40/125 H, 145 R, 125 F, 40/125 R

[56] References Cited

U.S. PATENT DOCUMENTS

| | | | |
|---|---|---|---|
| 1,439,982 | 12/1922 | Shrauger | 40/145 R |
| 1,455,103 | 5/1923 | Berry | 40/145 R |
| 2,631,392 | 3/1953 | Stevenson | 40/145 R X |
| 2,872,750 | 2/1959 | Holcomb | 40/125 H |
| 2,926,442 | 3/1960 | Reimel | 40/125 H |
| 3,132,431 | 5/1964 | Petrie | 40/125 F |
| 3,289,337 | 12/1966 | Golkowski | 40/125 H |

*Primary Examiner*—John F. Pitrelli

*Attorney, Agent, or Firm*—Sidney W. Millard

[57] ABSTRACT

A frame assembly for removably retaining one or more signboards. The assembly includes uprights formed of angle stock having a given internal angle. This internal angle configuration is used both to provide peripheral support for the signboards and supply necessary structural rigidity to the assembly, thereby minimizing the number of components thereof.

2 Claims, 8 Drawing Figures

FRAME ASSEMBLY FOR SIGNS

BACKGROUND

It has been and remains the practice within a variety of marketing fields to utilize portable signs capable of retaining any of a variety of advertising messages which are simply erected in the region of a property or structure being sold. For example, in the real estate field there has arisen the practice of erecting a sign near the roadway access of a property or house being offered for sale. Such signs will carry an identification and telephone number of the interested realtor as well as additional data such as the name of a salesman assigned to the sale and often a feature of relevancy of the property, such as the number of bedrooms and presence of a den and other popular features.

Inasmuch as a relatively great number of such signs generally are required in a given region, it is desirable that frame assemblies be available which easily receive and retain any of a broad variety of sign boards or sheets; which are easily erected on a property; which are easily transported in a salesman's automobile; and which are economical to manufacture. Ease in portability suggests that the sign be supportable by insertion of the legs or other appendages thereof into the terrain or soil to avoid bulksome transversely oriented bases and the like and to assure resilliance against commonly encountered wind loadings. To provide for such support, however, the frame assemblies must be sufficiently rugged to withstand hammer or light sledge blows incurred in the course of their erection. Sign board retention features of the frame assembly should be such as to permit facile insertion and removal as well as to assure an adequate peripheral engagement to provide security against a loss thereof due to wind-loading and the like. Insertion of the sign should be simple, being carried out without the utilization of connectors, dual frame enclosure structures and the like. Where justified by cost, the frame assemblies also should be capable of accommodating sign boards or sheets of varying sizes, again without recourse to the use of connectors such as bolts and the like. Simplicity of manufacture looks to the attainment of necessary structural features suited to allow for erection as well as sign retention without recourse to the utilization of complex components or a multitude of such components. Of course, the frame assemblies also must exhibit a design that is esthetically pleasing in nature so as not to detract from the advertising message supported thereby.

SUMMARY

The present invention is addressed to improved frame assemblies for removably receiving and retaining sheet material signs. Uniquely structured both for necessary strength and convenience of use, the assemblies of the invention also exhibit an esthetically desirable appearance. Through a unique utilization of angle stock, considerable economies and efficiencies are gained in the manufacture of the inventive assemblies, thus permitting their fabrication at desirably low unit costs.

Another feature of the invention is to provide a frame assembly for removably retaining a sheet material sign which incorporates first and second upright structures each having one portion configured for insertion into supporting terrain and having another portion disposed upwardly therefrom and fashioned of angle stock material. Such angle stock material is characterized in being formed having elongate flanges mutually integrally associated to exhibit corresponding internally disposed surfaces which define an internal angle extending from an internal apex. The assemblies further include first and second mutually spaced and parallel cross-member assemblies which have termini rigidly connected with the first and second upright structures. Such cross-members are configured to retain the upright members of the noted angle stock material in a mutually spaced, parallel relationship and in orientations wherein the internal angles thereof are arranged in mutually facing orientations symmetrically disposed about a plane extending in common between the apexes of the noted internal angles.

Another object and feature of the invention is to provide a frame assembly as described above in which the first cross-member assembly is positioned between the first and second upright structures at or substantially near the upwardly disposed ends thereof. This first cross-member assembly is formed of two bar members the oppositely disposed ends of which are rigidly joined, for instance, by welding, with corresponding mutually opposite internally disposed surfaces of the angle stock. Further the point of connection with the upright stock material is spaced from the noted apexes of the internal angles such that a slot is defined between the bar members through which the noted plane may extend and through which the sign material may be inserted.

As another object of the invention the above-noted second cross-member assembly may be formed as a bar member rigidly connected, for instance by welding, between the first and second uprights and located within the noted plane extending between the apexes of the internal angles. Thus positioned, this bar member serves as lower support for a sign board or sheet when such sheet is inserted within the frame assembly.

As another object, the frame assembly of the invention may be formed incorporating an arrangement for removably retaining more than one, for instance a second, sign board or sheet material sign, at a location above the noted first cross-member assembly, such retention arrangement being formed by channel members rigidly fixed in mutually spaced apart relationship upon one of the first or second bar members in a manner wherein the open, slot defining sides of the channel sections are in mutually facing relationship.

Another object of the invention is to provide a frame assembly of the type generally described hereinabove wherein one, the lower portion of each of the first and second upright assemblies of the sign are formed of the noted angle stock and fashioned having a tip properly configured for insertion within the ground or terrain and extending from that tip along a select length to a base support portion extending normally to the axis of the stock material. This extension is provided a select distance to a second tip and the internally disposed surfaces of this extension are normally upwardly disposed for purposes of providing one base support portion for a sign retained within the assembly. The other portion of the upright is also of stock material and is attached to the second tip or the tip of the base support portion and extends therefrom vertically to provide peripheral support for the sign member retained therein. By extending the angle stock of the upwardly disposed other portion, and bending it slightly to contact with the lower stock portion, a dual attachment between these portions is achieved for improved rigidity as well as improved aesthetic appearance. This embodiment of the invention further may be arranged for retaining three differently sized sign boards, one being formed within the lower portion, the principal sign board being incorporated as in the earlier embodiments and a third sign board being retained by channel members as described hereinabove.

Another feature and object of the invention provides a third cross-member arrangement for the sign structure wherein each of the first and second upright structures is configured incorporating a plurality of regularly spaced apertures formed therethrough, the apertures corresponding between the two upright structures are coaxially arranged within the plane intended for the sign board retention, the axes between the apertures are mutually parallel so that the cross-member may be positioned at any appropriate level to serve as a lower support for a sign board or the like. To provide attachment between the upright members and the sign, the third cross-member is formed having a fixed pin extending from one side thereof and a pin which is depressable utilizing spring means within a chamber formed within the member for the opposite side. Accordingly, the cross-member is readily inserted and adjusted for height within the frame assembly.

Other features of the invention will, in part, be obvious and will, in part, appear hereinafter.

The invention, accordingly, comprises the apparatus possessing the construction, combination of elements and arrangement of parts which are exemplified in the following detailed disclosure.

For a fuller understanding of the nature and objects of the invention, reference should be had to the following detailed description taken in conjunction with the accompanying drawings.

DETAILED DESCRIPTION

Figure 1:
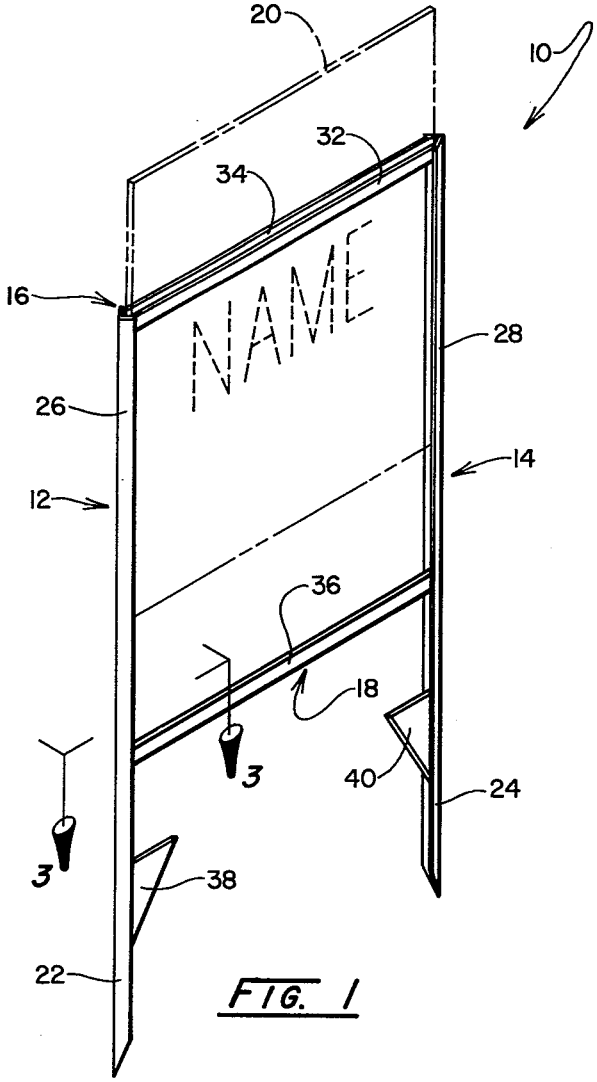
FIG. 1 is a perspective drawing of one frame assembly embodiment of the invention.
Figure 2:
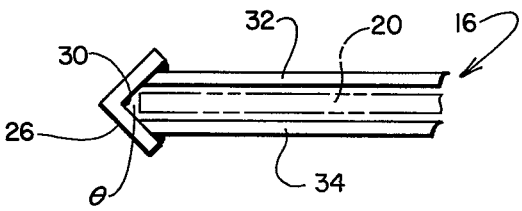
FIG. 2 is a partial top view of the frame assembly of FIG. 1.
Figure 3:
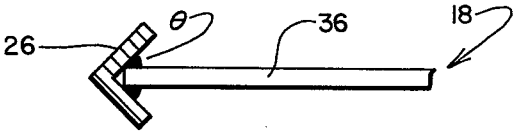
FIG. 3 is a sectional view taken in the direction 3—3 of FIG. 1.

Looking to FIG. 1, one embodiment for the frame assembly of the invention is revealed generally at 10. Ideally simple in structure and yet retaining a pleasing esthetic quality, assembly 10 is formed of two uprights shown generally at 12 and 14, as well as two spaced parallel cross-member assemblies, revealed generally at 16 and 18. These components are combined in a rigid structural arrangement to removably retain a sign board or sheet material sign depicted in phantom at 20 as partially inserted within assembly 10.

Uprights 12 and 14 comprise lower portions shown respectively at 22 and 24 which are configured for removable insertion into supporting terrain or ground, as well as upwardly disposed portions, shown respectively at 26 and 28, having the particular function of retaining portions of the periphery of sign 20. In the embodiment shown at 10, uprights 12 and 14 are formed of a unitary alojgata lejgth ob metal angle stock which may be selecte havinc an internal angle, identified in the cross-sectional figures, i.e. FIGS. 2–5, 7 and 8, as "$\theta$", and shown in the embodiments depicted as being selected as about 90°. The angle is defined between the internally disposed surfaces of the elongate flanges forming the angle stock. Note that these internal surfaces extend from an apex represented in the figures at 30.

Cross member assembly 16 is formed of two bar members 32 and 34 which are connected between upward portions 26 and 28 of respective uprights 12 and 14 in a manner wherein the internal angles, $\theta$ , of the uprights are retained in mutually facing relationship, symmetrically disposed about a plane which may be considered to extend in common through the internal apexes 30 of the uprights. As is revealed in FIG. 2, the oppositely disposed ends of bars 32 and 34 are rigidly joined, as by welding, with the corresponding mutually opposite internally disposed surfaces of upright portions 26 and 28. The position of this connection is spaced from the apex 30 such that the bars 32 and 34 define a slot through which the noted plane within which sign board 20 resides is extensible.

Lower assembly 18 is provided in the embodiment of FIG. 1 as a singular bar member which is rigidly connected between uprights 12 and 14 in parallel with bars 32 and 34 of assembly 16, however, connection is made at the apex 30 of the internal angle $\theta$.

Accordingly, sign board 20 is supported along its lowermost periphery by the upper surface of bar 36. Note with the arrangement shown, that assemblies 16 and 18 retain the internal angle of the angle stock uprights 12 and 14 in a mutually facing relationship and thus provide for lateral support along the upstanding peripheries of sign board 20 without the utilization of additional frame components, fasteners or the like. By eliminating such components, not only is the cost of production of the frame assembly reduced, but also a desirable esthetic quality is achieved. Further, the selection of angle stock is one providing for significant rigidity against wind loads and the like, as well as providing sufficient strength for erection procedures wherein the uprights 12 and 14 are driven into the ground by heavy hammers and the like. The selection of internal angle $\theta$ generally may be made from within a range of about 20° to 90°, the latter angle representing optimum structural rigidity while maintaining appropriate support about the peripheral edges of a sign board. Triangular inserts 38 and 40 optionally may be rigidly attached to respective lower portions 22 and 24 of uprights 12 and 14 to facilitate erection of the sign. For instance, the uppermost surface of the inserts may be utilized as a foothold for driving the frame assembly into the terrain.

Turning now to other embodiments of the frame assembly which retain the fundamental structural characteristics described in connection with the embodiment of FIG. 1, the numeration utilized hereinabove in connection with the embodiment of FIG. 1 is preserved in the designation of general components.

Figure 4:
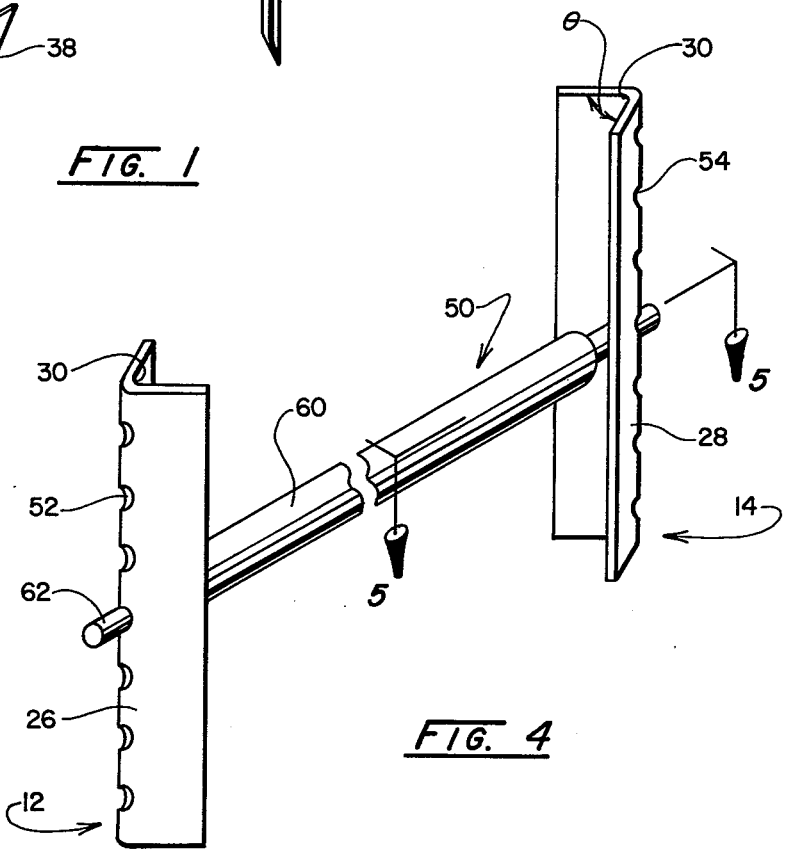
FIG. 4 is a partial pictorial representation of another embodiment of the invention.

Looking to FIG. 4, a supplemental cross-member assembly, shown generally at 50, is pictured extending between uprights 12 and 14 within the upwardly disposed portions thereof, respectively depicted at 26 and 28 residing above lower cross-member assembly 18 and below upper assembly 16. Note that the angle stock representing portions 26 and 28 is formed incorporating a plurality of regularly spaced apertures extending therethrough. These apertures are formed through the apex 30 of the stock and corresponding apertures between portions 26 and 28 are coaxially aligned along a common axis which is parallel to assemblies 16 and 18. Accordingly, assembly 50 serves as a lowermost support for a sign board as at 20. However, the position or height of assembly 50 within the frame assembly 10 is manually adjustable by virtue of a detent or pin-type connection. In this regard, assembly 50 may comprise a tubular member 62 which is formed having a pin 62 fixed to and extending from one end thereof. Pin 62 is dimensioned having a diameter permitting its freely slidable insertion within a selected aperture as at either 52 or 54 depending upon the orientation of member 60. Where tubular stock is utilized for assembly 50, a conventional plug is inserted in one end, such plug additionally being formed incorporating pin 62. The plug may be attached or fixed within the end of the tube member 60 by swaging procedures or other suitable fastening.

Figure 5:
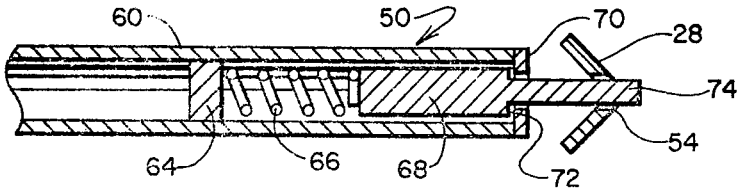
FIG. 5 is a sectional view taken in the direction 5—5 of FIG. 4.

Looking additionally to FIG. 5, the opposite side of assembly 50 is shown in cross-section. The figure reveals that a plug 64 is inserted within the end of tube 60 and is fixed therein by swaging or like attachment. Additionally, a helical spring 66 is inserted within the tube 60 to serve to outwardly bias a plunger-pin component 68. The outward travel of component 68 is limited by virtue of a shoulder 70 formed or connected at the end of tube 60 following the insertion of plug 64, spring 66 and component 68. This shoulder component serves to abut against a corresponding annular shoulder 72 formed within component 68. Accordingly, the outward travel of component 68 is limited, however, the pin portion 74 thereof is freely slideable through apertures as at 54 within portion 28 of upright 14. With the arrangement, the relative elevation of the lower sign support may be varied to suit the needs of the operator.

Figure 6:
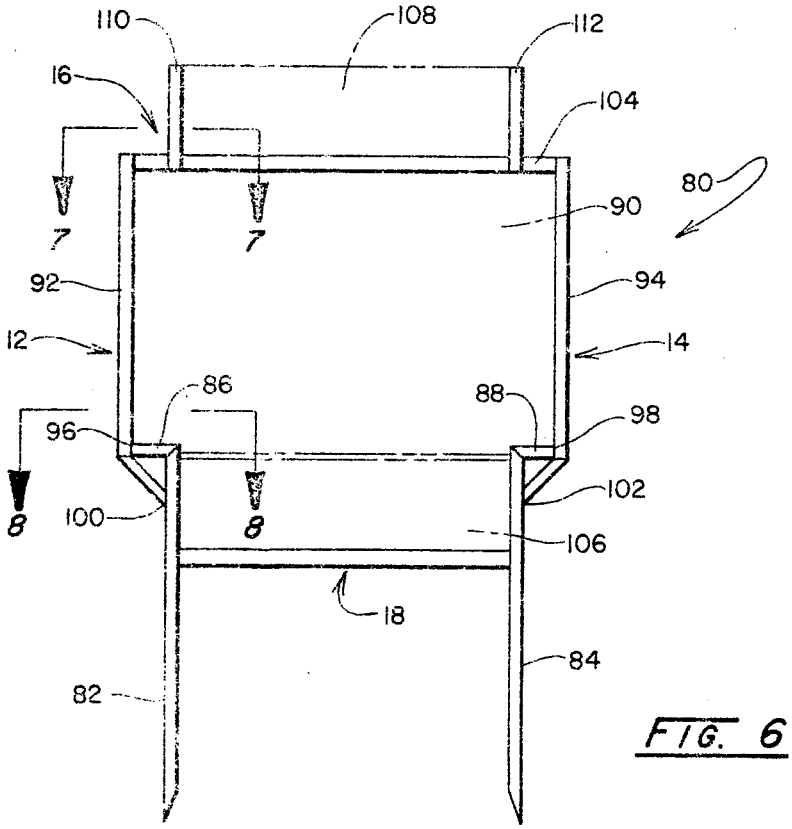
FIG. 6 is a front view of another embodiment for a frame assembly according to the invention.

Looking now to FIG. 6, another embodiment of the invention is revealed generally at 80. The assembly 80 is designed to retain three sign boards in a relatively vertical orientation. The embodiment incorporates the above-described feature wherein the internal angle of angle stock members serves to provide peripheral sign board support. In this regard, the lower portions 82 and 84 of respective uprights 12 and 14 are formed of angle stock with an internal angle, $\theta$, of about 90°, have sharpened tip configurations for insertion within the earth. Each portion 83 and 84 extends along a given axis whereupon they are bent in a 90° configuration to define base support portions shown respectively at 86 and 88. These base support portions 86 and 88 serve as the lower support for a sign as at 90 as additionally is portrayed in FIG. 8.

Where the internal angle, $\theta$, of the angle stock is selected as significantly less than 90°, a "mitered", i.e. two-piece, connection should be utilized to form base support portion 86 and 88.

Figure 7:
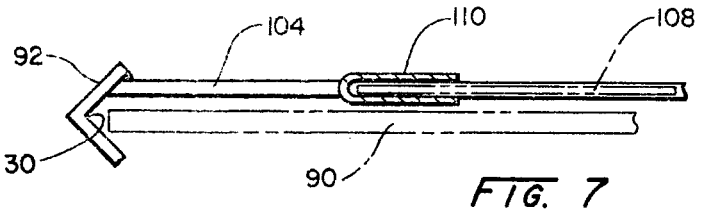
FIG. 7 is a partial sectional view taken in the direction 7—7 shown in FIG. 6.
Figure 8:
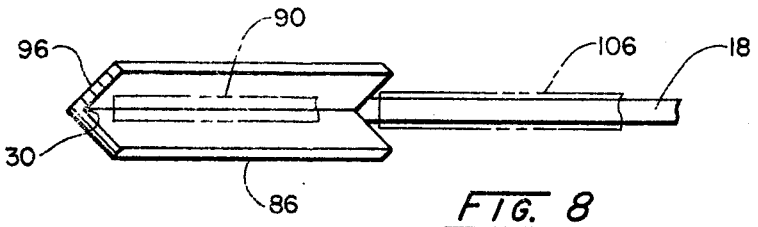
FIG. 8 is a partial sectional view taken in the direction 8—8 of FIG. 6.

The upper portions of uprights 12 and 14 are shown respectively at 92 and 94 and, as is represented in FIG. 7, are formed of angle stock having an internal angle apex 30 as designated earlier herein. Upper portions 92 and 94 are coplanar with respective lower portions 82 and 84 and are aligned, as in the earlier embodiment, such that the noted internal angles, $\theta$, thereof mutually face one another, their apexes 30 being coplanar. Connection between upper portion 92 and lower portion 86 is at the tip 96 of base support portion 86 and is provided by welding or similar appropriate rigid connection. Similarly, the tip 98 of base portion 88 is coupled to upper portion 94 by welding procedures or the like. Upper portions 92 and 94 also may be fashioned such that their lowermost tips, shown respectively at 100 and 102, are attached to respective lower portions 82 and 84 at points 100 and 102 spaced below respective base support portions 86 and 88. The slight bend formed in upper portions 92 and 94 required for this connection is seen to enhance the ornamentation of the assembly 80 and the dual connection as by welding provided with the arrangement serves to enhance the rigidity of the assembly.

Lower portions 82 and 84 are supported and spaced apart by lower cross member assembly 18 in identical fashion as shown and described in connection with the embodiment of FIG. 1. Somewhat similarly, the upper cross-member assembly 16 is identically fashioned with the exception that only one bar member 104 is utilized, as is revealed in connection with FIG. 7. Bar 104 is welded to the surface of the internal angles of the bar stock of upper portions 92 and 94. The position of connection is spaced from the apex 30 of the internal angle to provide the noted peripheral support for a sign as at 90.

With the assembly thus described at 80, sign 90 is supported by the interior angles of upper portion angle stock 92 and 94 as well as by the upwardly facing stock portions 86 and 88. Further, a second sign 106 is provided immediately above lower cross-member assembly 18 and extending up to the vicinity of base members 86 and 88. Sign 106 is supported in similar fashion as described in connection with FIG. 1 with the exception that no upper cross member assembly is provided.

The singular bar member 104 of upper cross member assembly 16 has been found to provide adequate structural rigidity to the assembly with respect to its function of spacing uprights 12 and 14 at their uppermost extremities. Bar 104 further may support a bracket arrangement for retaining a third sign 108. In this regard, the singular bar 104 serves as the lower-most support for sign board 108, while two U-shaped channels 110 and 112 rigidly fixed thereto provide peripheral support. Attachment of channels 110 and 112 in a mutually spaced apart and facing relationship is provided by welding procedures or the like. In this regard, the lower portions of the channel members are slotted and positioned over bar 104 in the manner shown. As is apparent, this sign retaining arrangement can be utilized in conjunction with the embodiment of FIG. 1.

Since certain changes may be made in the above-described apparatus without departing from the scope of the invention herein involved, it is intended that all matter contained in the above description or shown in the accompanying drawings shall be interpreted as illustrative and not in a limiting sense.

I claim:

1. A frame assembly for removably retaining a sheet material sign about peripheries thereof comprising:

first and second upright means each having one portion configured for removable insertion into supporting terrain, each having another portion disposed upwardly from said one portion formed of angle stock having elongate flanges mutually integrally associated to exhibit internally disposed surfaces defining an internal angle therebetween extending from an internal apex;

first and second mutually spaced and parallel cross-member assemblies each having termini rigidly connected with said first and second upright means, configured to retain said first and second upright means one and other portions in mutually spaced parallel relationship and retaining at least said other, upwardly disposed, portions in orientations wherein said internal angles thereof are arranged in mutually facing relationship symmetrically disposed about a plane extending in common between the said internal apexes of said spaced first and second upright means other portions, said first cross-member assembly being positioned between said first and second upright means respective other portions at or substantially near the upwardly disposed ends thereof and comprising a first bar member, the oppositely disposed ends of which are rigidly joined with corresponding mutually opposite said internally disposed surfaces at positions thereon spaced from corresponding said apexes;

said one portion being fashioned having a first tip configured for insertion within said terrain and extending along a given axis therefrom a select length to a base support portion extending normally to said axis a select distance to a second tip, said internally disposed surfaces of said base support portion being normally upwardly disposed when said first tip portion is inserted within said terrain;

said other portion associated with said one portion being coplanar with and parallel to said given axis and rigidly coupled with said one portion second tip; and said second cross-member assembly comprising a bar member, the oppositely disposed ends of which are rigidly joined with the said one portion angle stock along the apexes of the internal angle exhibited by the internally disposed surfaces thereof at respective locations spaced from said base support portion, said section cross-member bar member and that portion of each said one portion angle stock extending to a respective said base support portion providing a three-edge periheral support for at least a second said sheet material sign.

2. A frame assembly for removably retaining a sheet material sign about peripheries thereof comprising:

first and second upright means each having one portion configured for removable insertion into supporting terrain, each having another portion disposed upwardly from said one portion each said one and other portion being formed of angle stock having elongate flanges mutually integrally associated to exhibit internally disposed surfaces defining an internal angle therebetween extending from an internal apex;

first and second mutually spaced and parallel cross-member assemblies each having termini rigidly connected with said first and second upright means, configured to retain said first and second upright means one and other portions in mutually spaced parallel relationship and retaining at least said other, upwardly disposed, portions in orientations wherein said internal angles thereof are arranged in mutually facing relationship symmetrically disposed about a plane extending in common between the said internal apexes of said spaced first and second upright means other portions, each said first and second upright means other portion being configured incorporating a plurality of regularly spaced apertures formed therethrough, corresponding said apertures within said first and second upright means being positioned coaxially within said plane along an axis parallel with said first and second cross-member assemblies;

and including a third cross-member assembly removably supportable along said axis between select said corresponding apertures comprising a rod member one end of which is formed having a pin fixed to and extending therefrom and configured for freely slideable insertion within a said aperture, the opposite end of said rod member including a chamber, a pin slideably mounted within said chamber and spring means intermediate said slideable pin and said chamber configured and arranged for normally biasing said slideable pin to move outwardly from said chamber, said slideable pin being freely slideable insertable within a said aperture.

* * * * *